United States Patent [19]

Schiffer

[11] Patent Number: 4,699,834

[45] Date of Patent: Oct. 13, 1987

[54] AN INTERMEDIATE FLOOR

[76] Inventor: Henry Schiffer, 21835 El Bosque Way, Boca Raton, Fla. 33433

[21] Appl. No.: 920,450

[22] Filed: Oct. 20, 1986

[51] Int. Cl.[4] ..... B44C 1/28

[52] U.S. Cl. ..... 428/49; 156/71; 428/150; 428/255; 428/256

[58] Field of Search ..... 156/71; 428/150, 255, 428/256, 49

[56] References Cited

U.S. PATENT DOCUMENTS

| | | | |
|---|---|---|---|
| 1,609,938 | 12/1926 | Forrest | 156/71 |
| 2,149,026 | 2/1939 | McBride | 156/71 |
| 3,705,830 | 12/1972 | Gurgui et al. | 156/71 |
| 3,909,144 | 9/1975 | Garn et al. | 428/489 X |
| 4,049,853 | 9/1977 | Tortolo | 156/71 X |
| 4,080,228 | 3/1978 | Currigan | 156/71 |
| 4,107,372 | 8/1978 | Clausen et al. | 428/256 |
| 4,287,263 | 9/1981 | Woodring et al. | 428/138 X |
| 4,349,588 | 9/1982 | Schiffer | 427/270 X |
| 4,518,548 | 5/1985 | Yarbrough | 156/71 X |
| 4,543,765 | 10/1985 | Barrett | 428/50 X |
| 4,554,769 | 11/1985 | Fujii et al. | 428/49 X |

*Primary Examiner*—Henry F. Epstein
*Attorney, Agent, or Firm*—Joseph Zallen

[57] ABSTRACT

A intermediate floor which shields a cementitious or tile top floor from the cracking of the original floor and comprises an asphaltic layer having on its upper surface finely divided stone and an open mesh layer on the stone layer. Where the original floor is concrete, the mesh layer is flexible plastic. Where the original floor is wood, the mesh layer is galvanized metal, staples being provided to hold the asphalt and mesh layers on the original floor.

5 Claims, 7 Drawing Figures

AN INTERMEDIATE FLOOR

BACKGROUND OF INVENTION

This invention relates ot a method of installing a intermediate floor onto an existing wooden or concrete floor. In particular, it relates to installing a intermediate floor on a cracked concrete floor or cracked wooden floor to permit the application of a cementitious or tile floor which will be shielded from any further cracking of the original floor.

The present applicant's U.S. Pat. No. 4,349,588 describes a system for making a simulated brick or tile wall or floor with a cementitious material. It was found that on some original floors, such as badly cracked concrete or wood, the resulting cementitious or tile floor also cracked.

One object of this present invention is to provide a intermediate floor to be placed on existing concrete and wooden floors which will provide a base for a cementitious or tile floor which will be shielded from the effects of cracking of the original floor.

Other objects and advantages of this invention will be apparent from the description and claims which follow taken together with the appended drawings.

SUMMARY OF INVENTION

The invention comprises generally making a intermediate floor by applying to a concrete or wooden floor a layer of asphalt material covered with tiny stones or pebbles embedded into the asphalt material to form a top layer on the asphalt. A commercially available roofing material known as Tamko #90/Slate Surface available in rolls, provides a suitable material which can be cut and laid on the original floor.

After the asphalt-gravel layer has been applied to the original floor, a grid is applied. In the case of a concrete floor, the grid can be a fine nylon or other plastic mesh. In the case of an original floor which is wood planking or plywood, the mesh is a fairly large galvanized metal netting such as 1 inch chicken wire. The fine nylon or plastic mesh will normally adhere to the asphaltic layer with an adhesive or cement without mechanical assistance. In the case of the galvanized wire, which has a greater stiffness, staples are used, as for example staples every 5 inches using a staple size of at least 1 inch. The staples penetrate into the wood.

The intermediate floor which has now been prepared can accept as a top floor the cementitious floors such as those described in U.S. Pat. No. 4,349,588 or individual ceramic on clay or cement tiles applied with conventional cements. The intermediate floor of this invention provides a shield against the cracking or further cracking of the original floor so that the top floor is stabilized.

BRIEF DESCRIPTION OF THE DRAWINGS

FIG. 1BB is an enlarged view of a portion of FIG. 1B.

SPECIFIC EXAMPLES OF INVENTION

Figure 1A:
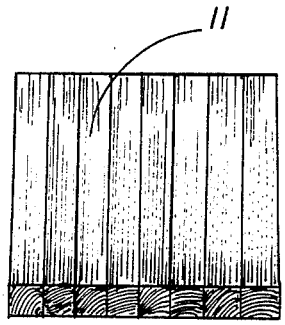
FIGS. 1A, 1B and 1C illustrate the sequence of providing an intermediate floor over wood planking.
Figure 1B:
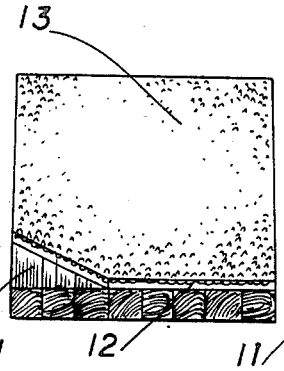
Figure 1C:
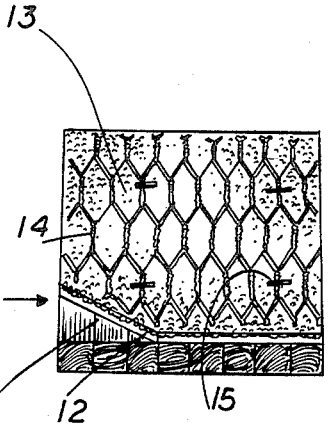
Figure 1B:
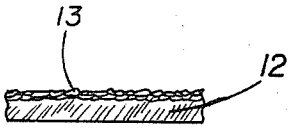

In the sequence illustrated in FIG. 1, cracked wood planking 11 is covered with an asphaltic sheet 12 embedded with pea gravel 13. Covering the pea gravel layer 13 is galavanized metal netting 14. One-inch stapeles 15 are positioned every 5 inches and extend through the asphaltic layer to the wood plank 11 to provide the intermediate floor.

Figure 2A:
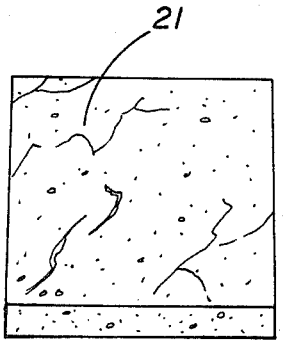
FIGS. 2A, 2B and 2C illustrate the sequence of providing an intermediate floor over a cracked concrete floor.
Figure 2B:
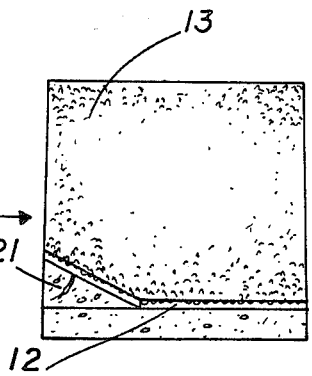
Figure 2C:
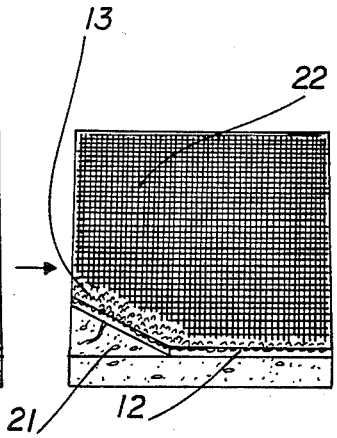

Referring now to FIG. 2 asphaltic layer 12 covered with a layer of pea gravel 13 is adhered to cracked concrete floor 21 with a cementitious material. A one-quarter inch nylor mesh 22 is then cemented to the asphaltic layer to provide the intermediate floor.

These intermediate floors isolate the cracks in the original concrete or wooden floor and provide a suitable surface for applying a top floor of cementitious material or separate ceramic, clay or concrete tiles.

A cement mixture for use in making a cementitious simulated water-based adhesive in the proportion of one gallon of water with one gallon of water-based adhesive having 50% solids, as for example, a polyvinyl acetate latex adhesive. Such adhesives are commercially available. To five gallons of this mixture are added approximately 100 pounds of dry cement mix comprising three parts sand and one part Portland cement. The amount of cement mix is adjusted to form a mortar that can be suitably spread. Powdered pigment is mixed in with the dry cement powder to give the desired color. The mixture is then applied to a desired depth (e.g. $\frac{1}{8}$ to 1 inch), on the intermediate floor with a trowel. The applied coating is then permitted to partially set. Scoring is then done with an appropriate tool to remove coating in a pattern of indentations resembling tiles. The coating with the indentations is permitted to set up completely and harden. Then, a clear water-resistant sealing coating, such as a polyurethene solution is applied to the entire surface. After the sealing coat has dried, mortar is applied in the indentations as a grout. The entire surface is sealed with clear water-resistant coating.

I claim:

1. An intermediate floor to be applied to an existing floor to shield a top cementitious or tile floor from cracking of the existing floor, comprising: an asphaltic layer having on its upper surface finely divided stone and an open mesh layer on the stone layer.

2. Claim 1 wherein the existing floor is concrete and the mesh layer is flexible plastic.

3. Claim 1 wherein the existing floor is wood and the mesh layer is galvanized metal, staples being provided to hold the asphalt and mesh layers against the existing floor.

4. A floor system comprising the intermediate floor of claim 1 and a top floor applied to said intermediate floor, said top floor comprising cementitious material, or separate ceramic, clay or concrete tiles.

5. The combination of an existing bottom floor, an intermediate floor positioned on said bottom floor, and a top cementitious or tile floor positioned on said intermediate floor; said intermediate floor comprising an asphaltic layer in contact with said bottom floor and having on its upper surface finely divided stone and an open mesh layer on the stone layer in contact with said top floor.

* * * * *